United States Patent [19]

Schreder

[11] Patent Number: 4,843,217

[45] Date of Patent: Jun. 27, 1989

[54] COOKING UNIT

[75] Inventor: Felix Schreder, Oberderdingen, Fed. Rep. of Germany

[73] Assignee: E.G.O. Elektro-Geräte Blanc u. Fischer, Fed. Rep. of Germany

[21] Appl. No.: 156,167

[22] Filed: Feb. 16, 1988

[30] Foreign Application Priority Data

Feb. 18, 1987 [DE] Fed. Rep. of Germany ... 8702478[U]
Jun. 13, 1987 [DE] Fed. Rep. of Germany ... 8708395[U]

[51] Int. Cl.[4] ..... H05B 3/70

[52] U.S. Cl. ..... 219/458; 219/464; 219/467

[58] Field of Search ..... 219/457, 458, 459, 460, 219/464, 448, 467, 449, 450, 463

[56] References Cited

U.S. PATENT DOCUMENTS

| | | | |
|---|---|---|---|
| 1,093,754 | 4/1914 | Ball | 219/458 |
| 1,238,793 | 9/1917 | Louth | 219/459 |
| 1,534,824 | 4/1925 | Ziola | 219/463 |
| 4,491,722 | 1/1985 | Fischer | 219/457 |

FOREIGN PATENT DOCUMENTS

| | | | |
|---|---|---|---|
| 1130574 | 5/1962 | Fed. Rep. of Germany | 219/457 |
| 1286726 | 1/1969 | Fed. Rep. of Germany | 219/463 |
| 2340818 | 2/1975 | Fed. Rep. of Germany | 219/464 |
| 746604 | 6/1933 | France | 219/459 |
| 574231 | 12/1945 | United Kingdom | 219/464 |

*Primary Examiner*—Teresa J. Walberg
*Attorney, Agent, or Firm*—Steele, Gould & Fried

[57] ABSTRACT

A cooking unit has electric hotplates (115) fitted in openings (113) of a mounting plate (112) and each electric hotplate is fixed against rotation. The associated rotation prevention member (14) can e.g. be an elastically movable tongue, which cooperates with a depression (132) in the vicinity of the outer, lower marginal edge (128) of the electric hotplate (115) and slopes upwards from the center in a substantially linear manner. However, even without any directly acting connection to the mounting plate, the rotation prevention member can prevent the rotation of at least two hotplates with respect to one another and combine the same to a rotation preventing compound unit. This leads to a constructionally very simple, easily assemblable and reliable fixing of the electric hotplates.

33 Claims, 6 Drawing Sheets

FIG. 2
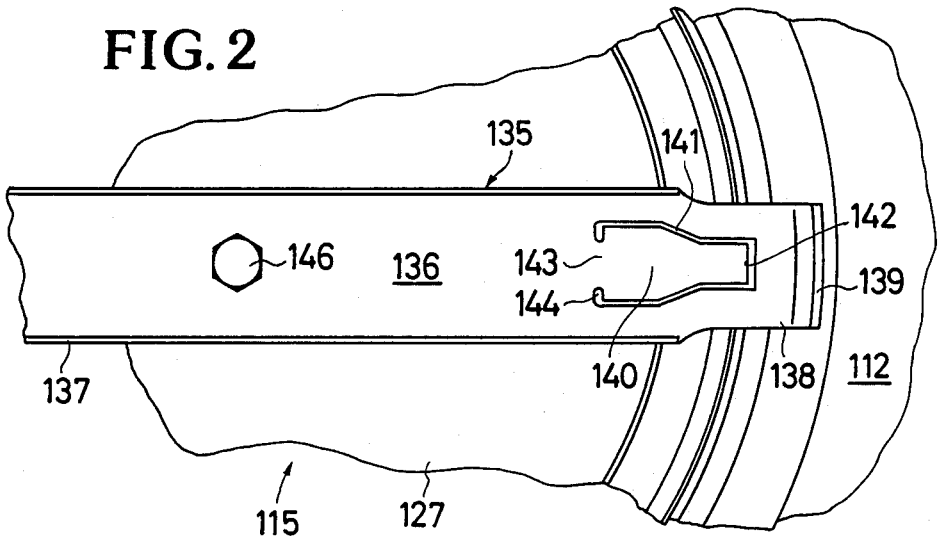
FIG. 4
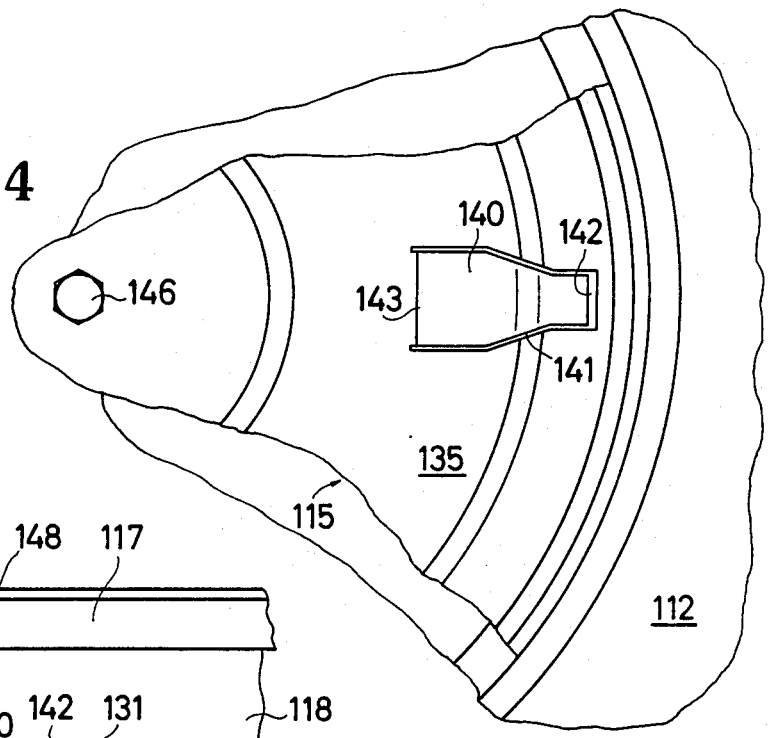
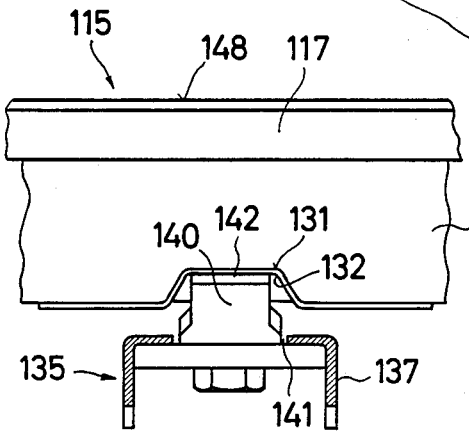
FIG. 6

COOKING UNIT

BACKGROUND OF THE INVENTION

1. Field of the Invention

The invention relates to a cooker with at least one electric hotplate and a mounting or trim plate receiving the same, and in particular to such a device wherein means are provided to fix the hotplate against rotation.

2. Prior Art

Cookers with an electric hotplate in a mounting or trim plate are known from DE-OS No. 29 33 296. Locking is brought about by a pin riveted into a retaining clip and engaging in a sleeve shaped or inserted into the bottom cover plate of the hotplate.

Another locking means construction is formed by a downwardly bendable sheet metal part, which is fixed by the central bolt of the electric hotplate. Locking the hotplate is important for the precise positioning of the connections, although the plate is generally circular on the top of the cooker.

An object of the present invention, in connection with a cooker, is to provide good connections, particularly further simplifying a rotation prevention means, so that the fixing of the rotation direction can take place particularly reliably and with limited manufacturing and assembly costs. According to the invention this object is achieved.

The rotation prevention means of the invention is not only a largely rigid member, which must be precisely passed into the depression provided for it, but also a vertically elastically movable tongue, which snaps into a corresponding border depression. The depression is already provided in the hotplates, so that an automatic alignment can be brought about during assembly. Due to the fact that the depression is located in the outer border region, an adequate locking is obtained with minimum forces exerted on the rotation prevention means. Moreover, in the preferred construction, in which the depression is provided in the cover plate of the hotplate, which in turn engages in a depression on the cast border of the electric hotplate, not only the cover plate, but also the cast body is positively rotationally secured. In embodiments in which the cover plate does not rest on the outer cast border of the hotplate body, the rotation prevention means could engage directly in a corresponding depression in the border or rim. The border depression preferably consists of a notch or indentation in the border and which consequently passes through the border at this point.

The rotation prevention means can still be simply kept effective if the hotplate is loose with respect to the mounting plate in that at least one special rotation prevention means is provided, which so interconnects at least two hotplates, that in the case of a rotary movement at least one of said two hotplates would be deformed, without it being necessary to have a direct connection of the rotation prevention means to the mounting plate or without such rotational forces being introduced into the mounting plate. As a result of the rotation prevention means, at least two hotplates can be combined to form a positively secured rotation prevention union, in which the hotplate bodies engaging in the rotation prevention means by means of the latter are reciprocally prevented from rotating, except for a small clearance. Thus, this indirectly leads to a positive locking of the hotplates with respect to the mounting plate.

As a function of the cooker construction at least two, three, more or all the electric hotplates can be drawn downwards with a common, plate-like retaining member in such a way that they are braced against the rims of the reception openings of the mounting plate and are consequently fixed in their vertical position, whereby the retaining member can engage on the central bolt or the central attachments of the hotplate body. Even if said retaining member or its fastening to the central bolt of the hotplate body loosens, the rotation prevention means of the invention is still effective. Nevertheless the retaining member can be incorporated advantageously into the rotation prevention means to the extent that it loads the latter upwards in its engagement position. If said loading is resilient, e.g. due to internal deformation of the sheet metal retaining member or the rotation preventing means, the positive rotation prevention is still retained if the retaining member loosens over a relatively long distance.

However, it is also conceivable to lock the rotation prevention means additionally and directly with respect to the mounting plate, e.g. in that on the bottom of the mounting plate is fixed a support element, e.g. by spot welding and said element fixes the rotation prevention means at least in its vertical position.

The rotation prevention means can engage in the particular hotplate only at a single point, which is appropriately outside the central axis thereof, or at two or more spaced points in retaining manner and they are then all spaced from the central axis or eccentric with respect to the hotplate rotation axis. The arrangement can be made such that the retaining forces are introduced into the rotation prevention means essentially only as thrust or tensile forces.

For the engagement of the rotation means, it is possible to provide on the particular hotplate openings, break-throughs, depressions, projections, lugs, bolts, etc., which are e.g. directly fitted to the cast iron hotplate body and/or to a part fixed thereto, e.g. to a lower, sheet metal end plate of the hotplate body.

Engagement can take place in simple manner by plug-in assembly, the plugging direction being appropriately approximately parallel to the central or rotation axis of the hotplate and directed against its bottom.

Other than in the case of a retaining frame for the heater of a glass ceramic hotplate, the inventive rotation prevention means of the invention does not have to fix the position and spacings of the central axes of the electric hotplates, because they are precisely defined by the reception openings of the mounting plate and to this extent the mounting plate fulfils the function of such a retaining frame. Thus, the rotation prevention means can be formed by individual rods connected to the hotplates in the manner of blocked or closed cranks, but can also be formed by a single plate or frame-like component with projections.

These and other features of the preferred further developments of the invention can be gathered from the claims, as well as the description and drawings and the individual features can be realized singly or in the form of subcombinations in any embodiment of the present invention and in other fields and can constitute advantageous, patentable constructions, for which protection is hereby claimed.

BRIEF DESCRIPTION OF THE DRAWINGS

The invention is described in greater detail hereinafter relative to embodiments and the attached drawings, wherein:

FIG. 2 is a part view from below of FIG. 1.

FIG. 4 is a part view from below of FIG. 3.

FIG. 6 is a detail section from FIG. 1.

DETAILED DESCRIPTION OF THE PREFERRED EMBODIMENTS

Figure 1:
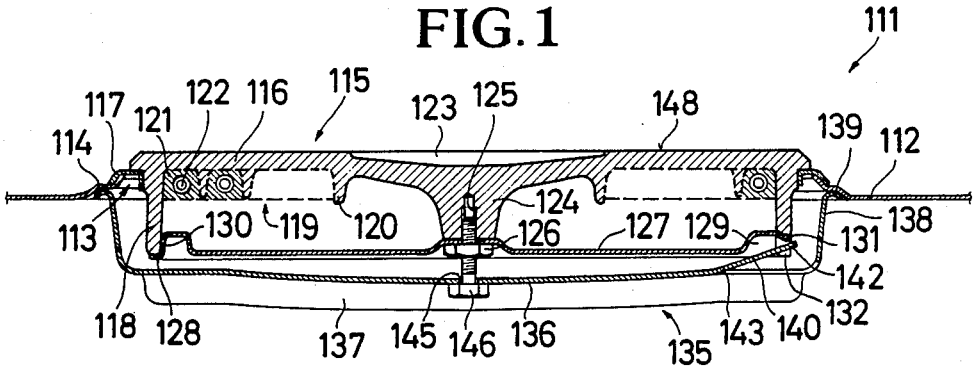
FIG. 1 is a cross-section through parts of a cooker with an electric hotplate fitted therein.

The cooker 111 shown in FIGS. 1 and 2 can comprise a single or multiple cooker, as well as a built-in hob. The upper cooker plate is constituted by a sheet metal mounting or trim plate 112 having openings 113 corresponding to the number of built-in electric hotplates and which are surrounded by a rising sill 114. On a shoulder of said sill engages the outer border or rim of a mounting or trim ring 117 surrounding the hotplate 115. The mounting ring is pressed externally on the cast metal hotplate body 116 of the electric hotplate and namely onto the substantially cylindrical outer surface of an outer rim 118 of hotplate body 116 and over it projects somewhat an outer flange, which is externally connected to the circular, planar and closed cooking surface 148 of the electric hotplate.

On the underside of the hotplate body and within the outer rim 118 are provided in spiral grooves 121 heater coils 122 made from resistance wire in a compressed, electrically insulating embedding material. They are arranged in a heated circular zone 119, which is bounded towards the center of the hotplate by a downwardly projecting inner border 120. The center of the hotplate is formed by an unheated central zone 123, which is bounded on the top surface by a slight lowering in cooking surface 148. In said area is cast a downwardly projecting central pin 124, which contains a central taphole 125 made from the bottom.

Into the taphole 125 is screwed a hollow screw 126 with an internal and external thread, fixed by its head on a cover plate 127, which covers the underside of the hotplate and in the represented embodiment rests with its outer rim on the lower border edge 128 of the outer border 118. For this purpose, apart from some reinforcing profiles, it has a substantially circular pressed-in part 129, which forms an outer centering shoulder 130, which is guided on the inside of border 118. In conjunction with the invention other shapes of cover plate 127 can be used, e.g. those leaving the central zone free and screwed in the center of the inner border 120.

On the circumference of electric hotplate 115, a cast depression 131 is provided in the border edge 128 of outer border 118 and interrupts said border, whereby it can be e.g. approximately 5 mm wide, 2 mm deep with downwardly and outwardly chamfered edges (FIG. 6). This recess firstly fixes the cover plate 127 with respect to the hotplate body in a rotation preventing manner and secondly in the recess 132 can engage a centering member of an assembly machine and both during manufacture and assembly hotplate 115 can turn into the current angular position.

The hotplate 115 is fixed at the bottom by a retaining member 135 in the form of a sheet metal-stamped clip, so that the mounting ring 117 rests on a shoulder of sill 114. The retaining member has a slightly curved central portion 136 and upwardly extending clip legs 138 supported by their outwardly circularly bent bearing edge 139 on the underside of the mounting plate 112 and namely in the area where the mounting ring 117 rests on the top surface. Thus, immediately after the introduction of the force bracing the hotplate 115 downwards, it is taken up again in the mounting plate and makes no contribution to the bracing of the mounting plate.

In the central portion of the retaining member, a threaded bolt 146 projects through a hole 145 and is screwed into the internal thread of the threaded bolt 126, so as to fix and tension the hotplate against the retaining member. The central area 136 is reinforced by upwardly bent reinforcing edges 137.

In the outer region of central portion 136, a rotation prevention tongue 140 is stamped from the material of the retaining member 135 in the clip and is bent out upwards, i.e. sloping towards the hotplate, so that the tongue heel 143 connecting the rotation prevention zone 140 to the clip is directed towards the center of the hotplate and the free end 142 slopes upwards and outwards. The rotation prevention zone is wider in its heel area and is narrow and strip-like at its end 142. In the heel area, as the clip material is relatively thick and stiff, cuts 144 are provided, which form a desired bending point there, although this is not generally necessary for thinner materials.

It can be gathered from FIGS. 1 and 6 that, during assembly, the rotation prevention tongue 140 is located in depression 132 and in the unloaded state it preferably slopes somewhat further upwards than shown in FIG. 1. On bracing together the hotplate 115 and retaining member 135, the rotation prevention tongue gives way downwards and is firmly positioned on the base of depression 132. The resulting downward movement of tongue 140 is in part elastic, but can also be in part plastic, particularly in the case of larger movements. There must be a certain residual elasticity which keeps the tongue pressed against the bottom of depression 132 when the plate 115 is braced, so that a contact pressure is always maintained. End 142 should be roughly as wide as depression 132. However, as a result of the contact pressure there is no need for a precise fitting for functional purposes. The bevels of the sides of depression 132 ensure a good introduction and self-centering of electric hotplate 115 with respect to retaining member 135. The described embodiment with a tongue 140 made from the material of retaining member 135 and bent out through a cutout 141 is particularly advantageous and makes it possible, without an additional component, to effect rotation prevention in an appropriate and reliable manner, in the case of simplified assembly. It would also be possible to provide a separate tongue, e.g. a riveted spring tongue. The spring tongue 140 should advantageously be constructed in such a way that its elastic mobility is substantially only present in the vertical direction, whilst it should laterally be as rigid as possible. This is ideally achieved in the described embodiment. An advantageous contribution can be made to this if, in place of the incisions 144, the desired bending point is formed by a central punched out hole.

Figure 3:
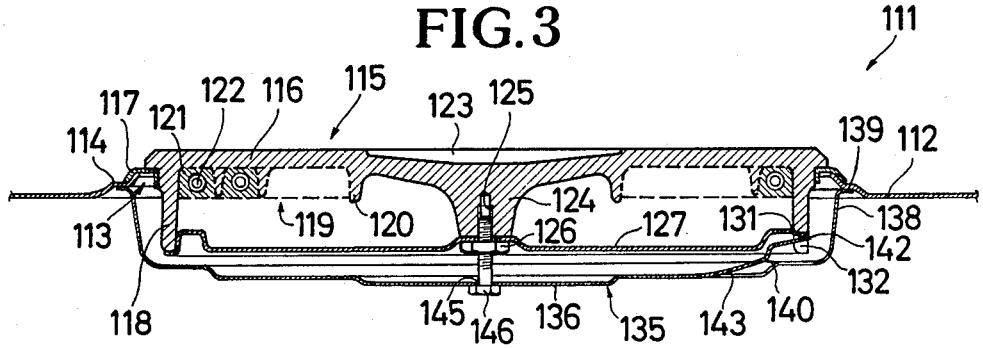
FIG. 3 is a representation corresponding to FIG. 1 of an embodiment with a retaining tray.
Figure 5:
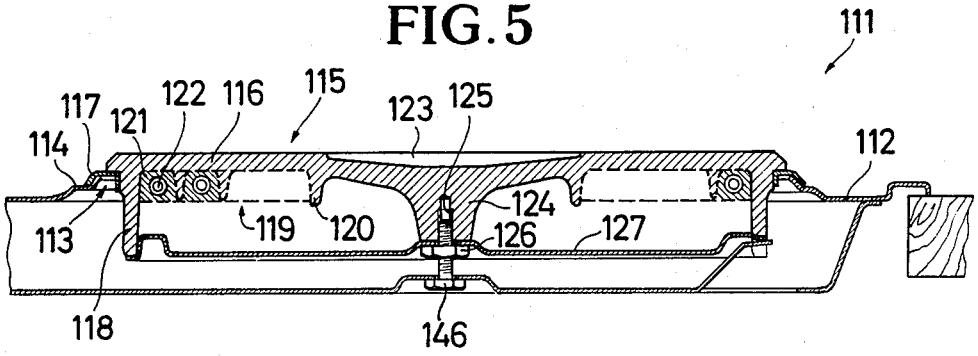
FIG. 5 is a representation corresponding to FIG. 1 of a construction with a receiving tray engaging below several electric hotplates.

In FIGS. 3 to 5, for a substantially identical mounting plate and electric hotplate, in each case a different retaining member configuration is described. Electric hotplate 115 and mounting plate 112 will consequently not be described in detail again.

In FIGS. 3 and 4 retaining member 135 is in the form of a sheet metal tray, whose cross-section largely corresponds to that of the retaining clip of FIG. 1. In the border region of its central portion 136 forming the tray bottom, the rotation prevention tongue 140 is stamped through a cut 141 and is bent out upwards in the same way as described relative to FIG. 1. The remaining construction and function are also the same, except that in the case of the thinner sheet metal material of the reception tray, there is no need for desired bending cuts 144. The rotation prevention tongue is S-shaped in accordance with the stepped-stamped tray bottom.

Whereas in FIGS. 3 and 4, a reception tray is provided as the retaining element 135 for each hotplate, in FIG. 5 there is a common reception tray for several hotplates. It forms a trough and e.g. constitutes the lower cover of a built-in hob. This reception tray forming the retaining member 135 is also supported on the underside of mounting plate 112, but does not pass all round in the vicinity of border 114. Here, in addition to the pressing as a result of the hotplate fixing, a further fastening can be provided. The individual hotplates are fixed to the reception tray through the threaded bolts 146. As in the previous embodiments, the threaded bolts can be replaced by other fastening modes, e.g. notch and snap fastenings.

For each hotplate, a rotation prevention tongue 140 is once again cut out of the material of reception tray 136 and is bent upwards in the aforementioned manner, where it is located in depression 132. So that there is no opening in the bottom in the case of a hob, it will be possible to have a separate tongue 140 and e.g. fit it by spot welding. It could also be directed in the other direction, e.g. from the outside to the inside, whereas this would not have been as advantageous in the previous embodiments as the arrangement described in connection therewith.

Figure 7:
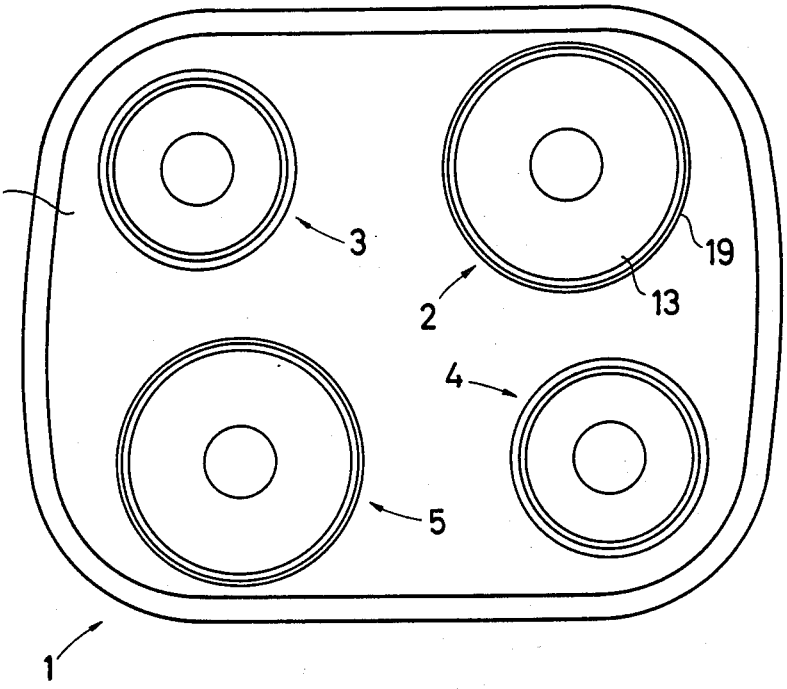
FIG. 7 is another embodiment of a cooker in the form of a hob to be installed in a support plate and in plan view.
Figure 8:
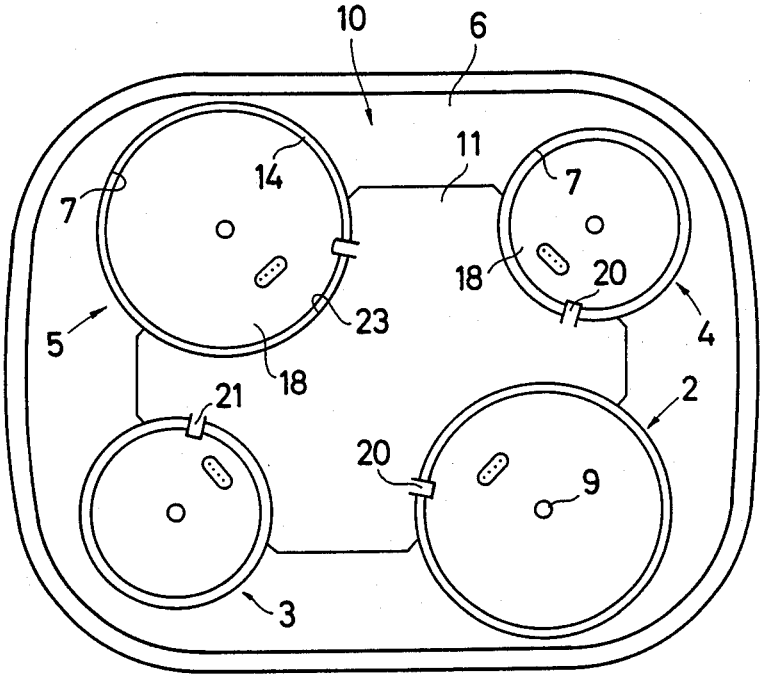
FIG. 8 is the cooker according to FIG. 7 in a view from below.
Figure 9:
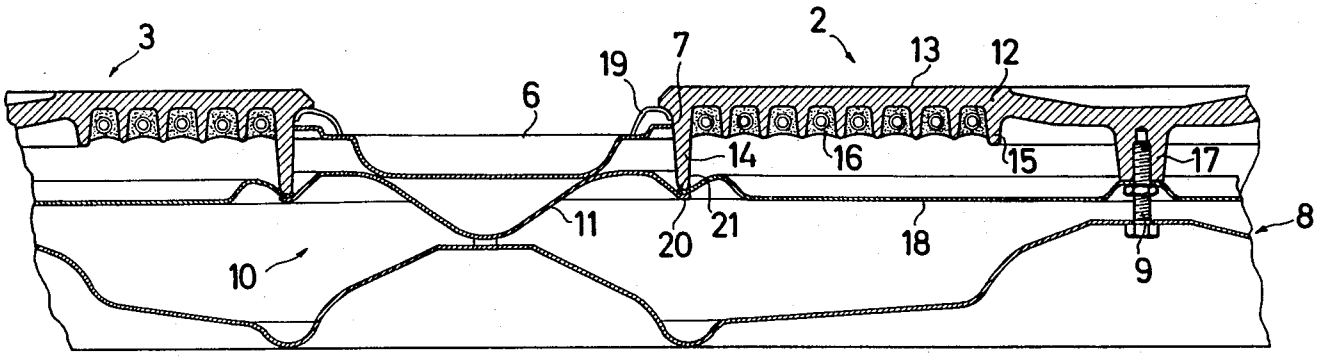
FIG. 9 is a partial section through the cooker according to FIG. 7 on a larger scale.

Cooker 1 according to FIGS. 7 to 9 has four cooking points, which are formed by separate, varyingly large or powerful electric hotplates 2 to 5. which are placed in reception openings 7 of a hob-like, sheet metal, deep-drawn mounting plate 6. Counter to their support on the top of the mounting plate 6, hotplates 2 to 5 are braced with a common retaining member 8, which can e.g. be constructed as a clip, plate, deep-drawn sheet metal part, etc., being located immediately adjacent to the undersides of hotplates 2 to 5 and through central bolts 9 passing through the same the hotplates 2 to 5 are resiliently secured with respect thereto. Between the retaining member 8 and the mounting plate 6 there can also be an additional insert body, e.g., in the form of an insert plate, which supports the zones of the mounting plate 6 located between the hotplates 2 to 5 with respect to the retaining member 8, so that the mounting plate 6, despite relatively weak dimensioning, has a relatively high bearing strength and deformation resistance.

In the vicinity of the bottom of the hotplates 2 to 5 is also provided a rotation prevention means 10, with which all the hotplates 2 to 5 are positively prevented from turning about their central axes. in which are also located the central bolts 9, with respect to the mounting plate 6 by more than the allowed angular dimension. The rotation prevention means 10 has a rotation prevention element 11, which can be directly formed by said insert palte and incorporates the retaining member 8 and mounting plate 6, because the rotation prevention member 11 is so resiliently braced between said two components in the height direction, that the rotation prevention member 11 on the one hand resiliently supports the mounting plate 6 and on the other hand is resiliently in rotation-preventing, positive engagement with the hotplates 2 to 5.

Each hotplate has a hotplate body 12 made from cast metal or some other suitable material, whose to forms an annular cooking surface 13 extending up to its outer circumference and over whose underside projects an outer, higher, annular flange border 14, as well as an inner, lower flange border 15 in the vicinity of the outer and inner boundaries of cooking surface 13. Between the flange borders 14, 15 a heating resistor 16 is arranged in at least one spiral groove of the hotplate body 12 and is embedded in a molded insulating material. In the unheated central area not covered by the heating resistor 16, the hotplate body 12 has a downwardly projecting, muff-like attachment 17, e.g. with an internal thread and in which is fixed the central bolt 9. The bottom of the hotplate body 12 is provided with a sheet metal or similar end plate 18, which is on the one hand supported on the lower end edge of the outer flange border 14 and on the other hand on the end face of attachment 17 and is e.g. fixed by means of a nut located on central bolt 9. Central bolt 9 tranverses the retaining member 8 located at a limited distance below the end cover 18 and engages on its underside with a bolt head, nut, etc. A collar of the hotplate body 12 projects over the outer circumference of the outer flange border 14 and on its underside is supported a profile diaphragm ring 19 mounted on its outer circumference and which in turn outside the outer circumference of the hotplate body 12 engages on the top of mounting plate 6 around the reception opening 7. Retaining member 8 or the rotation prevention member 11 or both these parts can have dome or cam-shaped portions directed against one another, particularly in such a way that between hotplates 2 to 5 they are only supported on one another with the apexes of said shaped-out portions through very small-area engagement, it being conceivable to provide only one such central engagement in the centre of mounting plate 6.

For each hotplate 2 to 5, the rotation prevention member 11 has at least one or a single projection 20 projecting roughly parallel to the cooking surfaces 13, which is constructed in one piece with member 11, or can be formed by a component, such as a link plate or the like fixed to said member. Projection 20 projects roughly radially against the central axis of the associated hotplate 2 to 5 and engages in a recess or depression 21 in the lower end edge of the flange border 14 of the associated hotplate body 12 in such a way that it can project at least so far over its inner circumferential surface that, in the case of limited rotary movements of the hotplate body, a complete sliding of projection 20 out of this gear tooth system is prevented. On its border engaging on said end edge, the end plate 18 has a corresponding depression 22 formed by a shaped-out portion according to FIG. 10, which engages in the depression 21, so that the end plate 18 assumes a predetermined position with respect to the hotplate body 12 and is secured in this position. Thus, in this case, the projection 20 indirectly engages in depression 21, namely in depression 22. For at least one and in particular all hotplate bodies, the rotation prevention member 11 has in each case one concave-bounded cutout 23, which is adapted to the outer circumference of the flange border 14 of the associated hotplate body and surrounds same over part of its circumference with a limited spacing and an arc angle of appropriately more than 90° and less than 180°. Projections 20 are provided in the vicinity of these cutouts and the projections 20 for in each case adjacent, juxtaposed hotplates 2 to 5 are at right angles or approximately right angles to one another and approximately parallel to the adjacent outer edges of the rotation prevention member 11 or to one of the two median planes of mounting plate 6.

Figure 12:
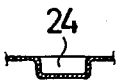
FIG. 12 is a part section of FIG. 11.
Figure 11:
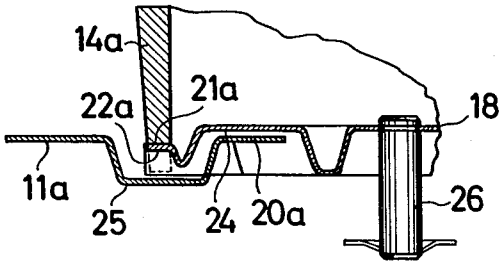
FIG. 11 is a detail of FIG. 10 in a larger scale sectional representation.
Figure 10:
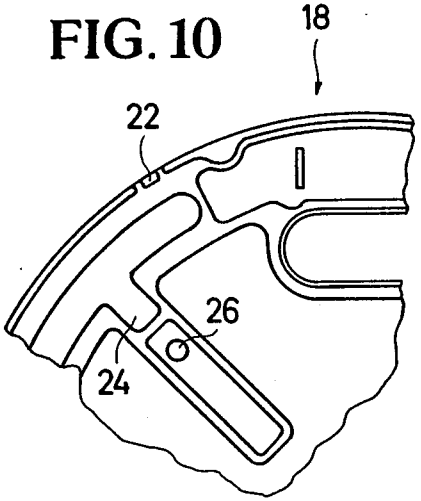
FIG. 10 is a view from below of a detail of an end plate for a hotplate.

As is also shown in FIG. 10, the end plate 18 is profiled in many different ways, so that numerous depressions and protuberances are formed. In addition to or instead of engaging in depression 21 or 22, the rotation prevention member 11 could also engage in at least one other depression or protuberance. Radially within the outer circumference and depression 22, the end plate 18 is e.g. provided on the underside with a part ring groove-like depression passing over most of its circumference and whose ends are located in the vicinity of an opening for receiving an insulating body for the leads of the heating resistor 16. From said depression extend several, e.g. four uniformly circumferentially distributed depressions 24 directed towards the center of end plate 8 in the manner of radial attachments, which can e.g. have a flat, rectangular groove profile according to FIG. 12. As shown in FIG. 11, the rotation prevention member **11*a* can lock only through the engagement of projection 20*a* in such a depression 24, the projection 20*a* then appropriately passing via an offset or multiply bent connecting portion 25 into the rotation prevention member 11*a*, which is passed round the end edge of flange border 14*a*** in such a way that there is no engagement in said flange border.

FIGS. 10 and 11 also show a projection projecting beyond the bottom of the end plate 18 or a bolt 26 riveted to said end plate for the locking engagement of a rotation prevention member, whereby there are appropriately two such bolts 26 angularly spaced from one another on either side of the opening for the insulating body and radially adjacent to the depressions 24. For the engagement in such a bolt 26, the projection of the rotation prevention member then appropriately has a plug-in opening and for securing the projection on the bolt 26, it is possible to mount a securing member, e.g. a claw disk. Otherwise in FIG. 11 the same reference numerals as in FIGS. 7 to 10 are used for corresponding parts, but are followed by the letter a.

Figure 13:
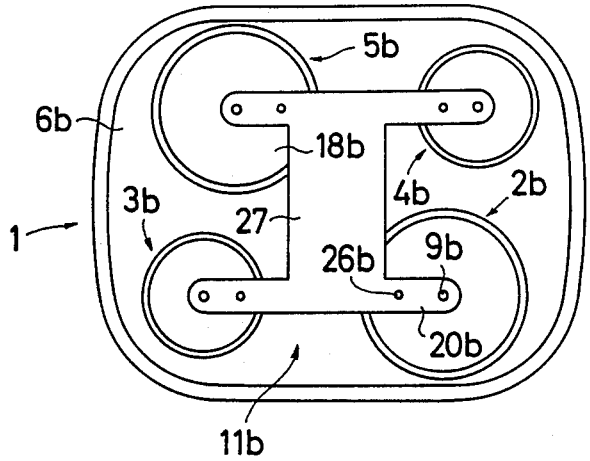
FIGS. 13 to 15 are further embodiments of cookers in representations corresponding to FIG. 8.
Figure 14:
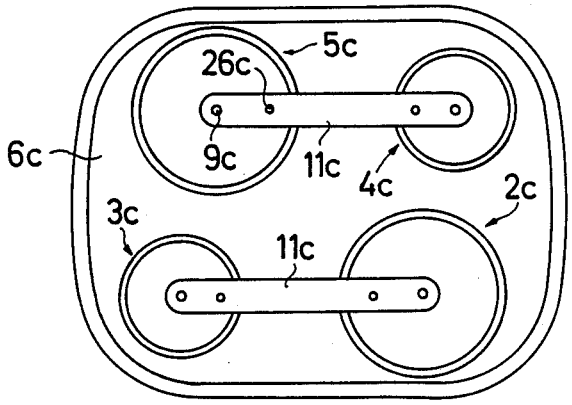
Figure 15:
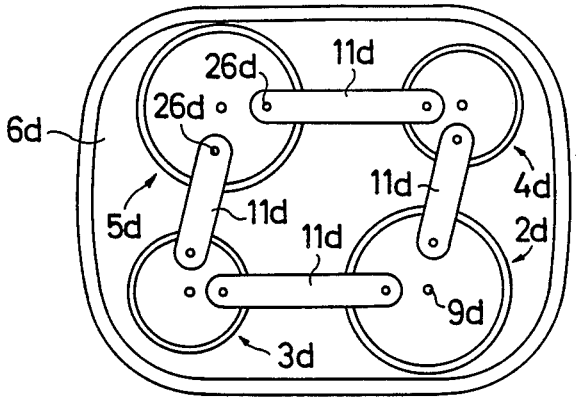

In FIGS. 13 to 15 the same reference numerals as in FIGS. 7 to 12 are used for corresponding parts, but are followed by b in FIG. 13, c in FIG. 14 and d in FIG. 15.

The approximately H-shaped rotation prevention member **11*b* according to FIG. 13 has a central, elongated, rectangular, plate-like part 27, in the vicinity of whose narrow edges project four arm-like projections 20*b* at right angles to the longitudinal edges thereof. Each projections 20*b* is mounted with an opening in the vicinity of its end on the central bolt 9*b* of the associated hotplate 2*b* to 5*b* and with an opening located adjacent thereto in its longitudinal direction on the associated bolt 26*b*, so that a rotation prevention is obtained with only a very limited rotation clearance. With respect to the central bolt 9*b*, the rotation preventing member 11*b*** is secured by appropriate bolt heads, nuts or the like (not shown).

Whereas in the embodiments according to FIGS. 7 to 13, in each case all the hotplates are secured by means of a common rotation prevention member, according to FIG. 14 there are two groups of hotplates **2*c*, 3*c*, or 4*c*, 5*c*, which are in each case rotation-secured with respect to one another and independently of the remaining hotplates, so that e.g. there can be a pairwise rotation prevention of the hotplates. The reciprocally rotation-prevented hotplates are appropriately adjacent to one another in the direction of the front or rear boundary edge of mounting plate 6*c*, although they can also be adjacent to one another at right angles thereto. Each rotation prevention member 11*c* is formed by a strip-like flat rod, whose median longitudinal plane is roughly located in the common axial plane of the associated hotplates 2*c*, 3*c* or 4*c*, 5*c*. The two rotation prevention members 11*c*, which are appropriately identically constructed, are approximately parallel to one another and engage both in the associated central bolts 9*c* and in the bolts 26*c***.

According to FIG. 15, individual, flat rod-like rotation prevention members **11*d* are at an angle to one another or are located on the edges of an imaginary polygon, but are reciprocally contact-free. The two ends of two rotation prevention members 11*d* engage in each hotplate 2*d* to 5*d* and appropriately in separate bolts 26*d* and in this case there is no engagement in central bolt 9*d*. FIGS. 8 and 13 to 15 do not show the retaining member 8 formed by the lower fastening trough. In place of said retaining member, it would also be possible to provide fastening clips for the particular hotplate or for two or more hotplates together and which would e.g. be supported directly on the underside of the mounting plate and in this case the rotation prevention member could be fixed beneath the fastening clip by screwing down, e.g. with the central bolt, similar to what is provided in the embodiments according to FIGS. 13 and 14**.

Figure 16:
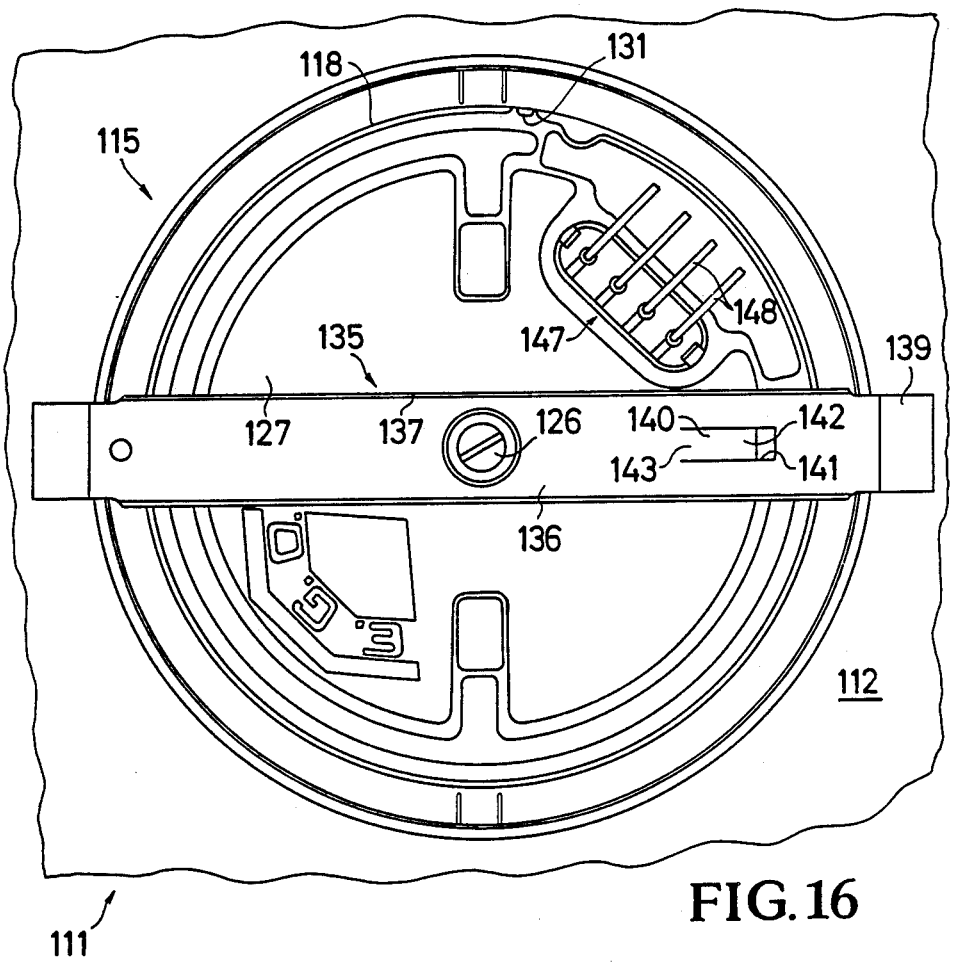
FIG. 16 is a further embodiment of the invention in a view on the bottom side.
Figure 17:
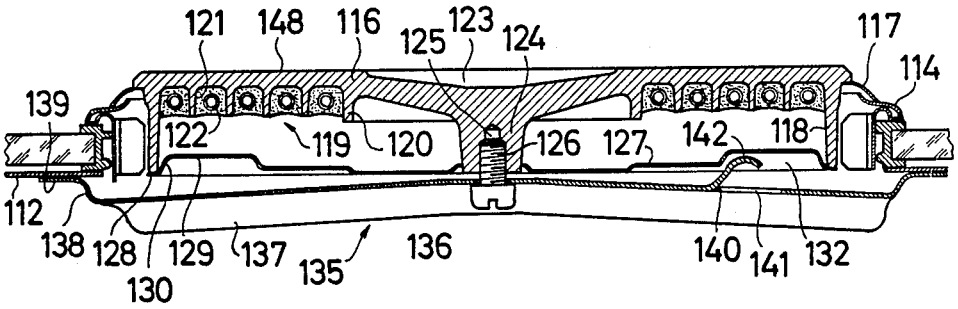
FIG. 17 is the embodiment according to FIG. 16 in cross section.

In the embodiment of FIGS. 16 and 17 the depression 132 for engagement of the free end 142 of the rotation preventing tongue 140 is not located in the vicinity of the outer rim 118, but displaced radially inwardly - when referred to the middle axis of the hotplate body - and this depression 132 is provided by a recessed shaping in the sheet metal cover 127. Although, this depression can extend up to the inner circumference of the outer rim 118, and thereby also provide a centering shoulder similar to the centering shoulder 130, however appropriately the depression's section provided for engagement of the tongue 140 is displaced radially inwardly with respect to this inner circumference. The free end 142 of the rotation preventing tongue 140 is appropriately bent arch- or like hook-like in such a way that the outer side of curvature is facing the cover sheet metal 127 respective the bottom of the depression 142, so that the tongue 140 can slide on the bottom side of the cover sheet metal 127 in the manner of a skid until the tongue hops into the depression. Furthermore, this provides a relatively great length extension of the edge for supporting the free end 142 with respect to the lateral flanks of the depression 132. The stiffening ledges (137) provided on the middle section 136 of the holding element 135 admittedly can be bent upwardly towards the cooking surface 148, too, but appropriately they are bent downwardly. Whilst in the embodiments, according to FIGS. 1 and 3, the middle section 136 of the holding element 135 is arched respective terraced away from the bottom side of the hotplate body 116 when narrowing the center respective the bolt or screw 126, this middle section 136 is arched towards this bottom side in the embodiment of FIGS. 16 and 17. Furthermore, the screw 126 is not constructed as a hollow screw, but as a normal screw having a screw head, whereas the cover sheet metal 127 is secured with respect to the outer circumference of the central trunnion 124 by means of a securing member, namely claw tongues constructed in one piece with the cover.

In the embodiment of FIGS. 16 and 17, the recess 131 in the cast material and the protrusion of the cover sheet metal 127 engaging in this recess and also providing a depression are furthermore circumferentially displaced with respect to the depression 132, whereby these recesses 131 are forming the positioning element for the rotational positioning of the cover sheet metal 127 with respect to the hotplate body 116 in such a way, that a connection piece member 147 arranged on the bottom side of the electric hotplate and provided for the electric connection is located laterally directly adjacent to the holding element 135. The connecting pins 148 projecting from the connecting piece 147 on the bottom side of the hotplate body substantially radially outwardly and parallel to each other are oriented at an oblique angle with respect to the longitudinal direction of the holding element 135 and are situated in an acute angle to the adjacent half section part of this holding element 135, when viewed at towards the bottom side according to FIG. 16.

I claim:

1. A cooking unit comprising:

an upper mounting plate (112);

at least one electric hotplate (115) arranged in a reception opening (113) of said mounting plate (112), said electric hotplate (115) having an outer lower marginal edge (128), at least one depression (132), being provided in the vicinity of said outer, lower marginal edge (128);

at least retaining member (135) for fixing said electric hotplate (115) by downward bracing in said reception opening (113), said retaining member (135) and said electric hotplate (115) being engaged by tightening means (146) for tightening said electric hotplate (115) against said mounting plate (112) and, at least one rotation prevention member (140) acting between said electric hotplate (115) and said retaining member (135), wherein said rotation prevention member (140) is at least one tongue member provided on said retaining member, said rotation prevention member (140) cooperating with said depression (132) and being elastically movable with respect to said retaining member (135).

2. The cooking unit according to claim 1, wherein said tongue member (140) is substantially vertically elastically movable, but is substantially rigid in lateral directions.

3. The cooking unit according to claim 1, wherein at least one tongue member (140) is provided between ends of a retaining clip forming the retaining member (135), said retaining clip being supported on an underside of said mounting plate (112).

4. The cooking unit according to claim 1, wherein at least one tongue member (140) is provided on a reception tray engaging below one or more hotplates (115) and braced therewith and which forms the retaining member (135).

5. The cooking unit according to claim 1, wherein said tongue member (140) is bent out in one piece from the material of said retaining member (135).

6. The cooking unit to claim 1, wherein the hotplate body (116) having a bottom cover sheet (127) provided with said depression by shaping of said cover sheet is provided, at least one tongue member (140) resiliently engaging said depression (132) of said cover sheet (127), said depression being formed by a protrusion in turn engaging in a recess (131) in the cast material of said hotplate body (116) respective in said lower marginal edge (128) in an outer border flange (118) of said hotplate body (116).

7. The cooking unit according to claim 1, wherein at least one tongue member (140) has a free end (142) and a heel portion bounding with said retaining member (135), said heel portion having a greater width than said free end (142).

8. The cooking unit according to claim 1, wherein at least one tongue member (140) has cuts for providing a predetermined bending zone, said cuts (144) and bending zone being located in the vicinity of a heel portion (143) of said tongue member (140), said heel portion being located adjacent to the retaining member (135).

9. The cooking unit according to claim 1, wherein said electric hotplate has a center, at least one tongue member (140) being directed in upwardly sloping manner from said center of the electric hotplate (115).

10. The cooking unit according to claim 1, wherein at least one tongue member (140) is shaped substantially between a straight extension and an extension corresponding to a contour of said retaining member (135).

11. The cooking unit according to claim 1, wherein said retaining member (135) has a central portion (136) and at least one marginal portion (138) at an angle to said central portion (136) adapted for receiving tightening means (146), said at least one marginal portion (138) being adapted for engaging said mounting plate (112), said tongue member (140) being provided on said central portion (136).

12. A cooking unit (1) comprising: an upper mounting plate (6) having reception openings (7) and a bottom side; at least two electric hotplates (2 to 5) arranged in said reception openings (7) of said mounting plate (6) and a rotation prevention means (10) engaging into said bottom side of said mounting plate, wherein at least one specific rotation prevention member (11) is provided for acting directly between at least two electric hotplates (2 to 5), said rotation prevention member (11) combining said at least two electric hotplates to form a positively secured rotation prevention compound.

13. The cooking unit according to claim 12, wherein at least one of said at least two electric hotplates (2 to 5) is free of direct positive antirotation connections with said mounting plate (6), said at least one electric hotplate being positively secured to another of said at least two hotplates against rotating with respect to the mounting plate (6), thereby forming an antirotating means preventing said electric hotplates from rotation indirectly with respect to said mounting plate (6).

14. The cooking unit according to claim 13 wherein said at least two electric hotplates (2 to 5) are positively prevented from rotating with respect to said mounting plate (6) exclusively by at least one interconnection positively engaging at least one of said at least two electric hotplates (2 to 5).

15. The cooking unit according to claim 12, wherein the rotation prevention member (11) located below the mounting plate (6) is connected to at least two hotplates (2 to 5) at least outside the central axes thereof.

16. The cooking unit according to claim 15, wherein a plate-like part of said rotation prevention means has cutouts (123) provided for receiving a circumference on an outer border flange (14) of at least one hotplate body (12), said projections (20) being located in the vicinity of said cutouts (23).

17. The cooking unit according to claim 12, wherein said rotation prevention member (11*b*) is connected to at least one of said at least two electric hotplates (2*b* to 5*b*) at two spaced locations one of said locations being located substantially in the central axis of said at least one electric hotplate (2*b* to 5*b*).

18. The cooking unit according to claim 12, wherein said reception opening (7) has a border, a retaining member (8) separate from said rotation prevention member (11) being provided for fixing at least one of said at least two electric hotplates (2 to 5) by downward bracing against said border of the reception opening (7).

19. The cooking unit according to claim 18, wherein said rotation prevention member (11) is tensioned upwardly substantially by said retaining member (8) against at least one of said at least two electric hotplates.

20. The cooking unit according to claim 18, wherein said rotation prevention member (11) is supported by braced engagement on said retaining member (8).

21. The cooking unit according to claim 12, wherein said rotation prevention member (11) is secured in a vertical position on said mounting plate (6) substantially on a single support bolt projecting from said bottom side of said mounting plate (6).

22. The cooking unit according to claim 12, whrein at least one depression (21, 22, 24) is provided in a bottom cover sheet (18) of said hotplate body (12).

23. The cooking unit according to claim 12, wherein said rotation prevention member (11) is connected to at least one of said at least two electric hotplates by engagement in at least one bolt (26*b*) projecting over said bottom side of said at least one electric hotplate (2*b* to 5*b*).

24. The cooking unit according to claim 12, wherein only one rotation prevention member (11) is connected to said at least two electric hotplates (2 to 5), said rotation preventing member (11) interconnecting a plurality of said at least two electric hotplates (2 to 5) in said mounting plate (6).

25. The cooking unit according to claim 12, wherein to at least one of said at least two electric hotplates of said mounting plate (6) are connected two rotation prevention members (11*d*) at two locations spaced from one another and from said central axis of said at least one electric hotplate.

26. A cooking unit (1) comprising:

an upper mounting plate (6) having reception openings (7) and a bottom side;

at least two electric hotplates (2 to 5) arranged in said reception openings (7) of said mounting plate (6) and a rotation prevention means (10) engaging in said bottom side of said mounting plate, wherein at least one specific rotation prevention member (11) acts between the at least two electric hotplates (2 to 5), said rotation prevention member (11) joining said at least two electric hotplates to form a positively secured rotation prevention compound unit connected to at least one of said at least two electric hotplates by engagement in at least one bolt (26*b*) projecting beyond said bottom side of said at least one electric hotplate (2*b* to 5*b*), said at least one bolt (126*b*) being fixed to the bottom cover-sheet (18*b*) of said hotplate body (12) in a region outside of a central axis of said at least one electric hotplate (2*b* to 5*b*).

27. A cooking unit (1) comprising:

an upper mounting plate (6) having reception openings (7) and a bottom side;

at least two electric hotplates (2 to 5) arranged in said reception openings (7) of said mounting plate (6) and a rotation prevention means (10) engaging in said bottom side of said mounting plate, wherein at least one specific rotation prevention member (11) acts between the at least two electric hotplates (2 to 5), said rotation prevention member (11) joining said at least two electric hotplates to form a positively secured rotation prevention compound unit, said rotation prevention member (11) having a plate-like portion located between said at least two electric hotplates (2 to 5), projections (20) projecting from said plate-like portion, said projections (20) being connected to said at least two electric hotplates (2 to 5).

28. A cooking unit (1) comprising:

an upper mounting plate (6) having reception openings (7) and a bottom side;

at least two electric hotplates (2 to 5) arranged in said reception openings (7) of said mounting plate (6) and a rotation prevention means (10) engaging in said bottom side of said mounting plate, wherein at least one specific rotation prevention member (11) acts between the at least two electric hotplates (2 to 5), said rotation prevention member (11) joining said at least two electric hotplates to form a positively secured rotation prevention compound unit, at least one said rotation prevention member (11*c*) being constructed in elongated manner, at the most a number of rotation prevention members (111*d*) corresponding to a number of hotplates being provided.

29. The cooking unit according to claim 27, wherein the rotation prevention member is constructed in flat rod-like manner.

30. The cooking unit according to claim 28, wherein the at least one rotation prevention member is constructed in strip-like manner.

31. The cooking unit according to claim 30, wherein said central portion (136) has an outer region, said tongue member (140) being provided on said outer region.

32. The cooking unit according to claim 30, wherein said central portion (136) has stiffening members (137).

33. The cooking unit according to claim 32, wherein said stiffening members (137) are bent reinforcing edges.

* * * * *